United States Patent [19]

Ozawa et al.

[11] Patent Number: 4,821,324

[45] Date of Patent: Apr. 11, 1989

[54] LOW BIT-RATE PATTERN ENCODING AND DECODING CAPABLE OF REDUCING AN INFORMATION TRANSMISSION RATE

[75] Inventors: Kazunori Ozawa; Takashi Araseki, both of Tokyo, Japan

[73] Assignee: NEC Corporation, Tokyo, Japan

[21] Appl. No.: 813,167

[22] Filed: Dec. 24, 1985

[30] Foreign Application Priority Data

Dec. 24, 1984 [JP] Japan ..... 59-272435
Aug. 13, 1985 [JP] Japan ..... 60-178911

[51] Int. Cl.[4] ..... G10L 9/04
[52] U.S. Cl. ..... 381/31; 364/513.5
[58] Field of Search ..... 381/29–41; 364/513, 513.5

[56] References Cited

U.S. PATENT DOCUMENTS 4,618,982 10/1986 Horvath et al. ..... 381/36
4,716,592 12/1987 Ozawa et al. ..... 381/40

*Primary Examiner*—Patrick R. Salce
*Assistant Examiner*—Emanuel Todd Voeltz
*Attorney, Agent, or Firm*—Sughrue, Mion, Zinn, Macpeak, and Seas

[57] ABSTRACT

In an encoder operable in response to a discrete pattern signal divisible into a sequence of segments to produce an output code sequence, each segment is produced during a frame and specified by representative excitation signals extracted from each segment. The representative excitation signals may be representative pulses placed in a selected one of subframes formed by dividing the frame with reference to a spectral parameter and a pitch parameter extracted from each segment. Alternatively, the representative excitation signals may be either a combination of the representative pulses and a noise or a noise alone. The representative pulses and the spectral parameters may be subjected to interpolation. In a decoder for decoding the output code sequence into a reproduction of the discrete pattern signal, the representative pulses are interpolated to arrange excitation pulses in all of subframes of each frame and to produce an excitation vocal source signal. The excitation vocal source signal may also be produced by the use of a decoded noise. A synthesizing filter circuit is driven by the excitation vocal source signal to produce the reproduction.

14 Claims, 6 Drawing Sheets

LOW BIT-RATE PATTERN ENCODING AND DECODING CAPABLE OF REDUCING AN INFORMATION TRANSMISSION RATE

BACKGROUND OF THE INVENTION

This invention relates to a low bit-rate pattern encoding method and a device therefor. The low bit-rate pattern encoding method or technique is for encoding an original pattern signal into an output code sequence of an information transmission rate of less than about 8 kbit/sec. The pattern signal may either be a speech or voice signal. The output code sequence is either for transmission through a transmission channel or for storage in a storing medium.

This invention relates also to a method of decoding the output code sequence into a reproduced pattern signal, namely, into a reproduction of the original pattern signal, and to a decoder for use in carrying out the decoding method. The output code sequence is supplied to the decoder as an input code sequence and is decoded into the reproduced pattern signal by synthesis. The pattern encoding is useful in, among others, speech synthesis.

Speech encoding based on a multi-pulse excitation method is proposed as a low bit-rate speech encoding method in an article which is contributed by Bishnu S. Atal et al of Bell Laboratories to Proc. IASSP, 1982, pages 614–617, under the title of "A New Model of LPC Excitation for Producing Natural-sounding Speech at Low Bit Rates." According to the Atal et al article, a discrete speech signal, namely, a digital signal sequence is derived from an original speech signal and divided into a succession of segments each of which lasts a special interval, such as a frame. Each segment is converted into a sequence or train of excitation or exciting pulses by the use of a linear predictive coding (LPC) synthesizer. Instants or locations of the excitation pulses and amplitudes thereof are determined by the so-called analysis-by-synthesis (A-b-S) method. At any rate, the model requires a great amount of calculation in determining the pulse instants and the pulse amplitudes. A great deal of calculation is also required in decoding the excitation pulses into the digital signal sequence For simplicity of description, the above-mentioned encoding and decoding will collectively be called conversion hereinafter.

In the meanwhile, a "voice coding system" is disclosed in U.S. Pat. No. 4,716,592, by Kazunori Ozawa et al, the instant applicants, for assignment to the present assignee. The voice or speech encoding and decoding system of the Ozawa et al patent application comprises an encoder for encoding a discrete speech signal sequence of the type described into an output code sequence. The system further comprises a decoder for producing a reproduction of the original speech signal as a reproduced speech signal by exciting either a synthesizing filter or its equivalent of the type of the LPC synthesizer.

More specifically, the encoder disclosed in the Ozawa et al patent application comprises a parameter calculator responsive to each segment of the discrete speech signal sequence for calculating a sequence of parameter representative of a spectral envelope. Each of the parameters may be referred to as a spectral parameter and is extracted from each spectral interval. Responsive to the parameter sequence, an impulse response calculator calculates an impulse response sequence which the synthesizing filter has for the segment. In other words, the impulse response calculator calculates an impulse response sequence related to the parameter sequence. An autocorrelator or covariance calculator calculates an autocorrelation or covariance function of the impulse response sequence Responsive to the segment and the impulse response sequence, a cross-correlator calculates a cross-correlation function between the segment and the impulse response sequence Responsive to the autocorrelation and the cross-correlation functions, an excitation pulse sequence producing circuit produces a sequence of excitation pulses by successively determining instants and amplitudes of the excitation pulses. A first coder codes the parameter sequence into a parameter code sequence. A second coder codes the excitation pulse sequence into an excitation pulse code sequence. A multiplexer multiplexes or combines the parameter code sequence and the excitation pulse code sequence into the output code sequence With the system according to the Ozawa et al patent application, instants of the respective excitation pulses and amplitudes thereof are determined or calculated with a drastically reduced amount of calculation. It is to be noted in this connection that the pulse instants and the pulse amplitudes are calculated assuming that the pulse amplitudes are dependent solely on the respective pulse instants. The assumption is, however, not applicable in general to actual original speech signals, from each of which the discrete speech signal sequence is derived.

It is well known that a female voice has a high pitch as compared with a male voice. This means that a greater number of pitch pulses appear in the female voice than in the male voice within each segment. Inasmuch as the excitation pulses are determined in relation to the pitch pulses, a high-pitch voice is encoded into the excitation pulses greater in number than a low-pitch voice. Therefore, the high-pitch voice can not faithfully be encoded in comparison with the low-pitch voice when the excitation pulses are transmitted at the low bit rate.

The instant applicants further have proposed an improved encoding and decoding system in U.S. patent application Ser. No. 751,818 filed July 5, 1985, for assignment to the present assignee. In the improved system, each spectral interval is divided into a succession of subframes with reference to the pitch pulses. A sequence of excitation pulses is produced for the respective subframes and is partially selected in consideration of signal to noise ratios which are calculated in two adjacent ones of the subframes. With this system, the excitation pulses are located in every other subframe and are not always located in the remaining subframes of each spectral interval. As a result, the excitation pulses can be reduced in number in the improved system and can be transmitted at a low transmission bit rate or information transmission rate.

However, the reduction of the excitation pulses has its limit because the excitation pulses must always be placed in every other subframe even when each subframe is not significant. This makes it difficult to transmit the excitation pulses at a transmission bit rate lower than 8 kbit/sec.

In addition, the reduction of the excitation pulses brings about an undesired or unnatural reproduction of the original pattern signal. Such an undesired reproduction becomes serious at a transition time instant between voices speech and unvoiced speech because desired excitation pulses can not be produced at the transition time instant. Thus, a speech quality is degraded at the transition time instant.

SUMMARY OF THE INVENTION

It is an object of this invention to provide a method wherein an output signal sequence is transmissible at a low transmission bit rate, such as 4.8 kbit/sec or so.

It is another object of this invention to provide a method of the type described, wherein an original pattern signal is naturally or desiredly reproduced at a transient time instant between voiced speech and unvoiced speech.

It is still another object of this invention to provide an encoder which is capable of encoding a discrete signal sequence into an output signal sequence transmissible at a low bit rate, such as 4.8 kbit/sec or so.

It is yet another object of this invention to provide a decoder which is communicable with an encoder of the type described and which can naturally reproduce the original pattern signal with a high fidelity.

It is a further object of this invention to provide a decoder of the type described, wherein it is possible to avoid degradation of a speech quality which would otherwise occur at a transition time instant between voiced speech and unvoiced speech.

A method according to this invention is for use in encoding a discrete pattern signal into an output code sequence and of decoding the output code sequence into a reproduction of the discrete pattern signal. The discrete pattern signal is divisible into a succession of segments. The method comprises the steps of extracting a pitch parameter and a spectral parameter from each segment and from a spectral interval which is not shorter than the segment, respectively, and dividing the spectral interval into a succession of pitch intervals in consideration of the pitch parameters extracted from the respective segments. Each pitch interval is shorter than the segment. The method further comprises the steps of processing the discrete pattern signal with reference to the spectral parameter and the pitch parameters to produce representative excitation signals specifying the discrete pattern signal in each spectral interval, rendering the representative excitation signals into said output code sequence, separating, from the output code sequence, decoded excitation signals which correspond to the representative excitation signals, and converting the decoded excitation signals into the reproduction of the discrete pattern signal.

DESCRIPTION OF THE PREFERRED EMBODIMENTS

Figure 1:
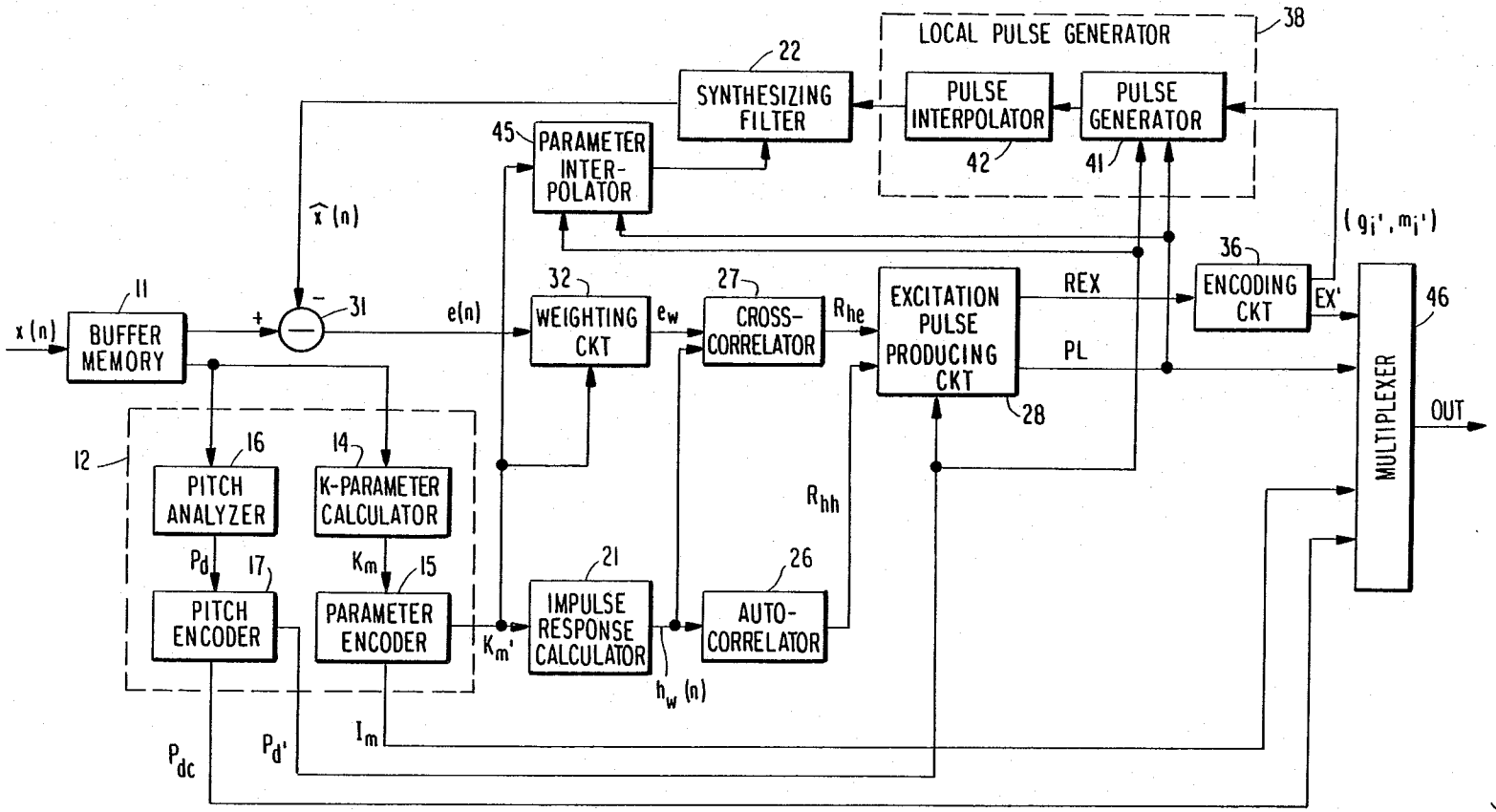
FIG. 1 is a block diagram of an encoder for use in a method to a first embodiment of this invention.

Referring to FIG. 1, an encoder is for use in a method according to a first embodiment of this invention to encode a digital signal sequence, namely, discrete pattern signal sequence x(n) into an output code sequence OUT. The digital code sequence x(n) is derived from an original pattern signal, such as a speech signal, in a known manner and is divisible into a plurality of segments each of which is arranged within a spectral interval Ts, such as a frame of 20 milliseconds, and which comprises a predetermined number of samples. Although the spectral interval is longer than each segment, the spectral interval or frame is assumed to be equal to the segment hereinunder. It is possible to specify the original pattern signal by a short-time spectral envelope and pitches. The pitches have a pitch period or pitch interval shorter than the segment. The original pattern signal is assumed to be sampled at a sampling frequency of 8 kHz into the digital signal sequence.

Each segment is stored in a buffer memory 11 and is sent to a parameter calculator 12. It is assumed that each segment is represented by zeroth through (N−1)-th samples, where N is equal to one hundred and sixty under the circumstances. The segment will be designated by s(n), where n represents zeroth through (N−1)-th sampling instants 0, . . . , n, . . . , and (N−1).

The illustrated calculator 12 comprises a K parameter calculator 14 for calculating a sequence of K parameters representative of the short-time spectral envelope of the segment s(n). The K parameters are called reflection coefficients in the above-referenced Atal et al article and will be referred to as spectral parameters in the instant specification. The K parameters will herein be denoted by $K_m$ where m represents a natural number between 1 and M, both inclusive. The K parameter sequence will be designated also by the symbol $K_m$. It is possible to calculate the K parameters in the manner described in an article which is contributed by R. Viswanathan et al to IEEE Transactions on Acoustics, Speech, and Signal Processing, June 1975, pages 309–321, and entitled "Quantization Properties of Transmission Parameters in Linear Predictive Systems."

Anyway, the K parameters $K_m$ are calculated in compliance with Viswanathan's algorithm and will not be described any longer.

A K parameter encoder 15 is for encoding the parameter sequence $K_m$ into a K parameter code sequence $I_m$ of a predetermined number of quantization bits. The encoder 15 may be of circuitry described in the above-mentioned Viswanathan et al article. The encoder furthermore decodes the first parameter code sequence $I_m$ into a sequence of decoded K parameters $K_m'$ which are in correspondence to the respective K parameters $K_m$.

The illustrated calculator 12 further comprises a pitch analyzer 16 for calculating a pitch parameter representative of the pitch period within each frame in response to each segment. The pitch parameter is produced as a pitch period signal Pd. The pitch period may be presumed to be invariable at every frame.

The calculation of the pitch period can be carried out in accordance with a manner described in an article contributed by R. V. Cox et al to IEEE Transactions on Acoustics, Speech, and Signal Processing, February 1983, pages 258–272, and entitled "Real-time Implementation of Time Domain Harmonic Scaling of Speech for Rate Modification and Coding." Briefly, the pitch period can be calculated by the use of an autocorrelation of each segment. Any other known methods may be used to calculate the pitch period Pd. For example, the pitch period can be calculated from a prediction error signal appearing after prediction of the segment in the known manner.

The pitch period signal Pd is delivered to a pitch encoder 17. The pitch encoder 17 encodes the pitch period signal Pd into a pitch period code Pdc of a preselected number of quantization bits on one hand and internally decodes the pitch period code Pdc into a decoded pitch period signal Pd′ on the other hand. The pitch period code Pdc and the decoded pitch period signal Pd′ are successively produced at every frame. Thus, the parameter calculator 12 serves to extract the pitch parameter and the spectral parameter, such as K parameter, from each segment and from the spectral interval, respectively.

The decoded K parameter sequence $K_m'$ is sent to an impulse response calculator 21 and to a synthesizing filter 22 in a manner to be described later. The synthesizing filter 22 has a transfer function while the impulse response calculator 21 calculates a sequence of weighted impulse response $h_w(n)$ which is representative of a weighted transfer function of the synthesizing filter 22. The weighted impulse response $h_w(n)$ can be calculated in compliance with the manner described in the copending U.S. patent application Ser. No. 751,818 referenced in the preamble of the instant specification and will not be described any longer.

The weighted impulse responses $h_w(n)$ are sent to both of an autocorrelator (or covariance calculator) 26 and a cross-correlator 27. The autocorrelator 26 is for use in calculating an autocorrelation or covariance function or coefficient $R_{hh}(\tau)$ of the weighted impulse response sequence $h_w(n)$ for a predetermined delay time $\tau$. The autocorrelation function $R_{hh}(\tau)$ is given by:

$$R_{hh}(\tau) = \sum_{n=1}^{N-\tau} h_w(n) \cdot h_w(n+\tau), \tag{1}$$

and is sent to an excitation pulse producing circuit 28 as an autocorrelation signal $R_{hh}$.

On the other hand, the discrete pattern signal sequence x(n) is read out of the buffer memory 11 and delivered to a subtractor 31 at every frame. The subtractor 31 is supplied with an output sequence $x(\hat{n})$ from the synthesizing filter 22 and subtracts the output sequence $\hat{x}(n)$ from each segment to produce a sequence of errors as results e(n) of subtraction.

The results e(n) of subtraction are given to a weighting circuit 32 which is operable in response to the decoded K parameter sequence $K_m'$. In the weighting circuit 32, the error sequence e(n) is weighted by weights w(n) which are dependent on the frequency characteristic of the synthesizing filter 22. Thus, the weighting circuit 32 calculates a sequence of weighted errors $e_w(n)$ in the manner described in the above-mentioned U.S. patent application Ser. No. 751,818.

The weighted errors $e_w(n)$ are delivered to both of the cross-correlator 27 and the excitation pulse producing circuit 28 in the form of a weighted error signal $e_w$.

The cross-correlator 27 calculates a cross-correlation function or coefficient $R_{he}(n_x)$ between the weighted error sequence $e_w(n)$ and the weighted impulse response sequence $h_w(n)$ for a predetermined number N of samples in accordance with the following equation:

$$R_{he}(n_x) = \sum_{n=1}^{N} e_w(n) \cdot h_w(n - n_x), \tag{2}$$

where $n_x$ is an integer selected between unity and N, both inclusive.

The calculated cross-correlation function $R_{he}(n_x)$ is sent to the excitation pulse producing circuit 28 as a cross-correlation signal $R_{he}$. The autocorrelation signal $R_{hh}$ and the cross-correlation signal may collectively called a preliminary processed signal. In this connection, the circuit elements (except the parameter calculator 12) for calculation of the preliminarily processed signal may be referred to as a preliminary processing circuit. Anyway, the preliminarily processed signal is indicative of a variable.

Now, the excitation pulse producing circuit 28 is operable in response to a sequence of the decoded pitch period signal Pd′, the autocorrelation signal $R_{hh}$ and the cross-correlation signal $R_{he}$ to produce a sequence of excitation pulses in a manner to be described later.

Figure 2A:
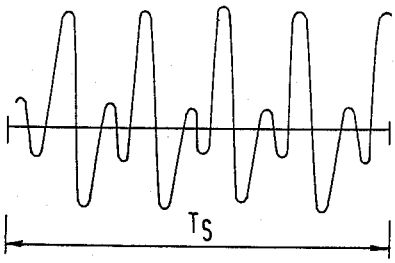
FIG. 2 is a time chart for use in describing operation of the encoder illustrated in FIG. 1.
Figure 2B:
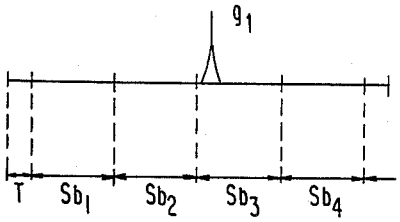
Figure 2C:
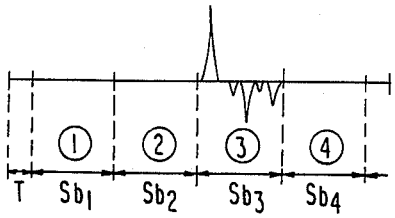
Figure 3:
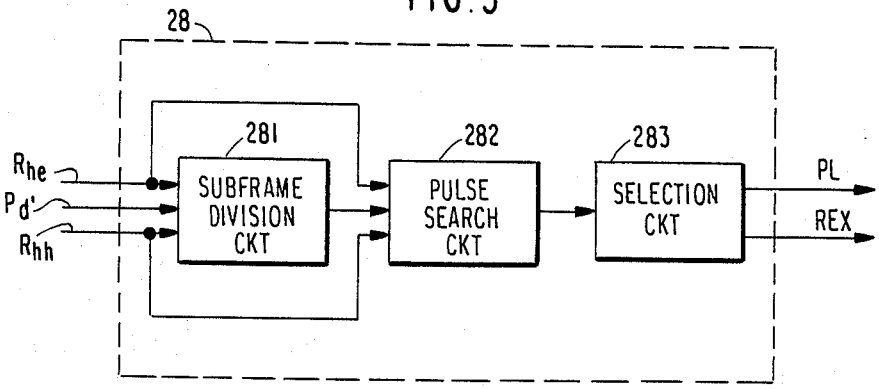
FIG. 3 is a block diagram of a part of the encoder illustrated in FIG. 1.

Referring to FIGS. 2 and 3 together with FIG. 1, description will be made as regards the excitation pulse producing circuit 28. In short, the excitation pulse producing circuit 28 is for dividing the spectral interval or frame $T_s$ into a succession of subframes $S_b$ and for producing a predetermined number of delimited or representative excitation pulses REX within a selected one of the subframes, in a manner to be described later.

More particularly, it is assumed that the above-mentioned operation is carried out as regards the original pattern signal which lasts for one frame $T_s$, as shown in FIG. 2(A). The excitation pulse producing circuit 28 at first divides each frame $T_s$ into the subframes $S_b$ which are coincident with the pitch periods indicated by the decoded pitch period signal sequence Pd′. In order to divide each frame $T_s$ into the subframes Sb, locations of pitch pulses should be detected from the original pattern signal as shown in FIG. 2(A). The locations of the pitch pulses can be determined from a first one of excitation pulses which specify a vocal source, as described in U.S. Pat. No. 4,716,592. For this purpose, the excitation pulse producing circuit 28 comprises a subframe division circuit 281 operable in response to the decoded pitch period signals Pd′, the autocorrelation signal $R_{hh}$, and the cross-correlation signal $R_{he}$, as shown in FIG. 3. The subframe division circuit 281 produces subframe location signals indicative of divided locations.

Let the first excitation pulse be calculated and have an amplitude $g_1$ with a first one of the locations assigned thereto, as shown in FIG. 2(B). The frame $T_s$ under consideration is divided into the subframes Sb with reference to the first location of the first excitation pulse and the decoded pitch period signal sequence Pd′. The illustrated frame $T_s$ is divided into first through fourth ones of the subframes depicted at $Sb_1$ to $Sb_4$, respectively. The pitch period or subframe does not always have the same phase as the frame $T_s$. It is assumed that the phase of the subframe Sb is shifted by a phase T relative to that of the frame $T_s$ in question.

Subsequently, the excitation pulse producing circuit 28 calculates a prescribed number of the excitation pulses at every subframe by the use of a pulse search circuit 282 as shown in FIG. 3. In the example being illustrated, the prescribed number is equal to six. The illustrated pulse search circuit 282 is supplied with the subframe location signals, the autocorrelation signal $R_{hh}$, and the cross-correlation signal $R_{he}$ to calculate the excitation pulses at every subframe.

A representative or typical one of the subframes Sb is selected by a selection circuit 283 illustrated in FIG. 3. In the illustrated example, the third subframe $Sb_3$ is selected as the representative subframe. The selection circuit 283 decides such a representative subframe by monitoring an absolute value of an amplitude of each excitation pulse in each frame. In the illustrated selection circuit 283, a subframe which has an excitation pulse of a maximum absolute value is decided as the representative subframe. The excitation pulses in the representative subframe are produced as the representative excitation pulses REX together with the phase T of the subframes Sb. In FIG. 2(C), the representative excitation pulses are derived from the third subframe $Sb_3$. At any rate, the representative excitation pulses REX and the phase T of the subframe specify a vocal source and may therefore be collectively referred to as vocal source information.

In the illustrated example, the vocal source information includes a location (subframe number) of the representative subframe, the phase T of the subframes, and the representative excitation pulses REX. Inasmuch as each representative excitation pulse REX is specified by an amplitude $g_i$ and a location $m_i$ or instant, the representative excitation pulses REX are sent from the excitation pulse producing circuit 28 to an encoding circuit 36 in the form of amplitude signals and location signals. The subframe number of the representative subframe is indicative of a location or instant of a representative pitch. The subframe number and the phase T of the subframes are encoded into a pitch location signal PL of a predetermined number of bits.

The excitation pulse producing circuit 28 may be a single chip microprocessor.

The encoding circuit 36 decodes the amplitudes and the locations of the local excitation pulses into local decoded amplitudes and instants $g_i'$ and $m_i'$, respectively, on the one hand and encodes the amplitudes and the locations of the representative excitation pulses REX into encoded amplitudes and encoded locations REX', respectively, on the other hand. Encoding of the encoding circuit 36 is carried out in the manner described in U.S. Pat. No. 4,716,592 referenced above. Any other encoding methods, such as differential encoding or the like may be used in the encoding circuit 36.

A local pulse generator 38 is coupled to the excitation pulse producing circuit 28, the encoding circuit 36, and the pitch encoder 17. Specifically, the pitch location signal PL, the local decoded amplitudes and instants $g_i'$ and $m_i'$, and the decoded pitch period signal sequence Pd' are given to the local pulse generator 38 from the excitation pulse producing circuit 28, the encoding circuit 36, and the pitch encoder 17, respectively. The illustrated local pulse generator 38 comprises a pulse generator 41 for reproduction of the representative excitation pulses REX and a pulse interpolator 42 which carries out interpolation to produce a sequence of reproduced excitation pulses in all of the subframes of each frame.

The reproduced excitation pulses are sent to the synthesizing circuit 22 coupled to the parameter encoder 15 through a parameter interpolator 45.

The parameter interpolator 45 is supplied with the decoded K parameter signal $K_m'$, the decoded pitch period signal sequence Pd', and the encoded pitch location signal PL representative of the phase T of the subframes and the representative pitch location. The parameter interpolator 45 divides the frame into a plurality of the subframes with reference to the decoded pitch period signal sequence Pd' and interpolates the decoded K parameter signal $K_m'$ in consideration of the encoded pitch location signal PL to produce a sequence of interpolated K parameter signals at every subframe. Such a parameter interpolator 45 may be operable in a manner described by J. D. Markel et al in "Linear Prediction of Speech" (published by Springer - Verlag in 1976).

Figure 4:
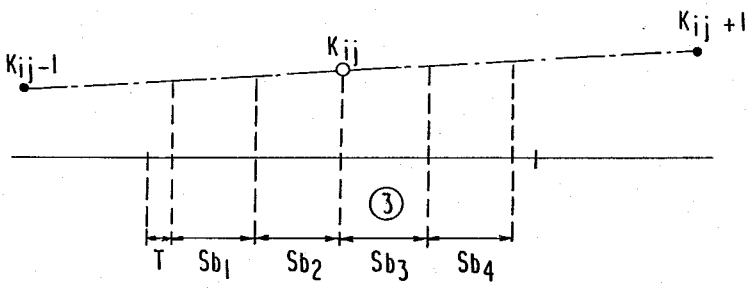
FIG. 4 is a time chart for use in describing operation of another part of the encoder illustrated in FIG. 1.

Temporarily referring to FIG. 4 together with FIG. 1, let linear interpolation be carried out in the second interpolator 45 as regards the decoded K parameter signal $K_m'$ located in a current one of the frames that is preceded by a preceding frame and that is followed by a succeeding one. When the current frame is represented by j, the preceding and succeeding frames can be represented by $j-1$ and $j+1$, respectively. It is assumed that the number of the K parameters calculated in each frame is equal to M and that an i-th one of the K parameters is given from the parameter encoder 15 to the second interpolator 45 during the current frame as the decoded K parameter signal $K_m'$. The parameter interpolator 45 allows the decoded K parameter signal $K_m'$ to pass therethrough during the representative subframe, such as $Sb_3$. During the remaining subframes of the current frame, the parameter interpolator 45 interpolates the i-th K parameter $K_{i,j}$ by the use of i-th K parameters $K_{i,j-1}$ and $K_{i,j+1}$ of the preceding and the succeeding frames $j-1$ and $j+1$, respectively. As a result, the parameter interpolator 45 delivers a sequence of interpolated K parameter signals to the synthesizing filter 22. For brevity of description, the number M of the K parameters K is assumed to be equal to unity, provided that a characteristic of the synthesizing filter 22 is invariable during each frame.

Supplied with the reproduced excitation pulses and the interpolated K parameter signals, the synthesizing filter 22 calculates a response signal for one frame in a manner similar to that described in U.S. Pat. No. 4,716,592 and supplies the subtractor 31 with the output sequence $\hat{x}(n)$ representative of the response signal.

In addition, a multiplexer 46 is supplied with the K parameter code sequence $I_m$, the coded pitch period sequence Pdc, the encoded location signal PL, and the encoded amplifiers and locations EX' to combine them together and to produce the output code sequence OUT. It is to be noted here that the illustrated output code sequence OUT includes the phase difference (T) between the frame and the subframes.

Figure 5:
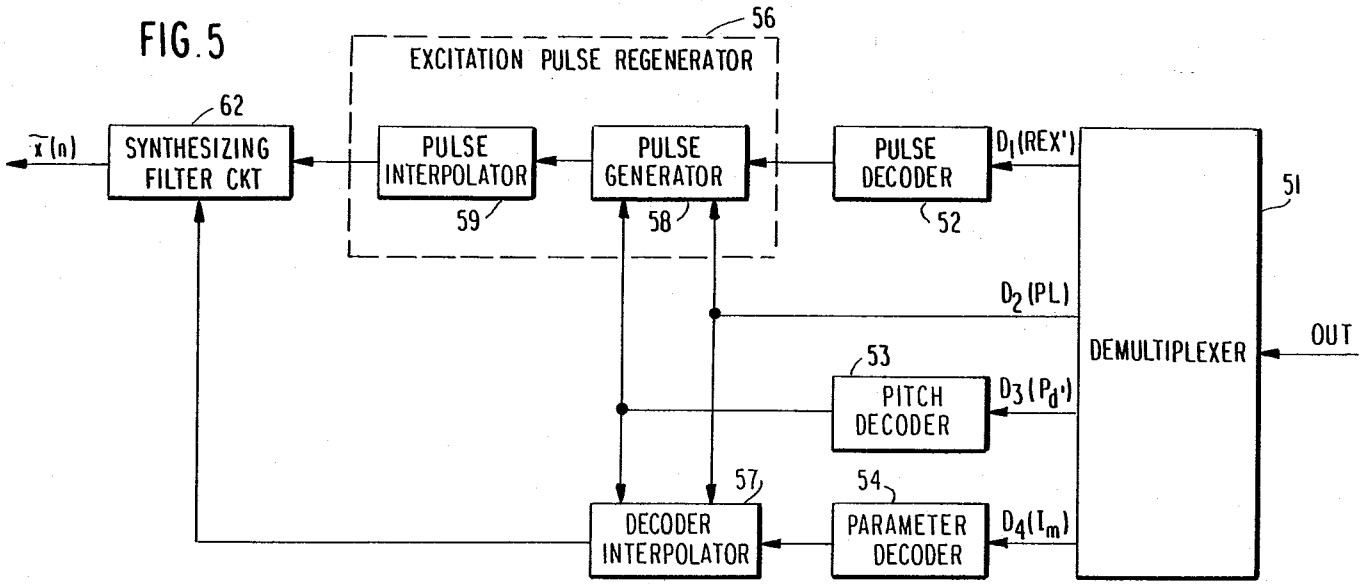
FIG. 5 is a diagram of a decoder for use in a method according to a first embodiment of this invention.

Referring to FIG. 5, a decoder is for use in combination with the encoder illustrated with reference to FIGS. 1 through 3 and comprises a demultiplexer 51 supplied as an input signal with the output code sequence OUT given from the encoder. The demultiplexer 51 demultiplexes the output code sequence OUT into a first demultiplexed code D1, a second demultiplexed code D2, a third demultiplexed code D3, and a fourth demultiplexed code D4. The first demultiplexed code D1 is representative of the amplitudes and locations of the representative excitation pulses REX' and therefore will be indicated at REX' while the second demultiplexed code D2 is indicative of the phase T of the subframes Sb and the location of the representative pitch and will be indicated at PL. The third demultiplexed code D3 stands for the pitch period Pd' to define the subframes while the fourth demultiplexed code D4 stands for the K parameter code sequence $I_m$.

The first, the third, and the fourth demultiplexed codes D1, D3, and D4 are delivered from the demultiplexer 51 to a pulse decoder 52, a pitch decoder 53, and a parameter decoder 54, respectively. The pulse decoder 52 decodes the first demultiplexed signal D1 into decoded amplitudes $g_i'$ and decoded locations $m_i'$ in a manner similar to the encoding circuit 36 of the encoder illustrated in FIG. 1. Combinations of the decoded amplitudes $g_i'$ and locations $m_i'$ corresponds to the representative excitation pulses arranged in the representative subframe and may be called decoded excitation signals. The decoded excitation signals may be varied with time and are delivered to an excitation pulse regenerator 56.

The pitch decoder 53 decodes the third demultiplexed codes D3 into a decoded pitch parameter corresponding to the decoded pitch period Pd' while the parameter decoder 54 decodes the fourth demultiplexed codes D4 into a decoded K parameter corresponding to the K parameter code sequence $I_m$. The decoded K parameter and the decoded pitch parameter are produced as a decoded K parameter signal and a decoded pitch signal, respectively, and may be referred to as first and second parameters, respectively.

The decoded K parameter signal and the decoded pitch signal are sent to a decoder interpolator 57 which is operable in the manner described in conjunction with the parameter interpolator 45 illustrated in FIGS. 1 and 3. Anyway, the decoder interpolator 57 interpolates K parameter at every pitch period with reference to the decoded K parameter signal and the decoded pitch signal to produce a sequence of interpolated K parameter signals which are placed in every subframe.

The excitation pulse regenerator 56 is supplied with the decoded excitation signals, the second demultiplexed code D2, and the decoded pitch signal. The second demultiplexed code D2 carries the phase T of the subframes and the location of the representative pitch, as mentioned before. Under the circumstances, the excitation pulse regenerator 56 at first divides each frame into a plurality of subframes at every pitch period Pd' in response to the phase T of the subframes, the location of the representative pitch, and the pitch period Pd'. Subsequently, the excitation pulse regenerator 56 produces regenerated excitation pulses which are placed in the representative subframe. Such regenerated excitation pulses have amplitudes and locations indicated by the decoded excitation codes given from the pulse decoder 52. In order to divide each decoder frame into the subframes and to produce the regenerated excitation pulses, the excitation pulse regenerator 56 comprises a pulse regenerator 58. The regenerated excitation pulses are delivered from the pulse regenerator 58 to a pulse interpolator 59. The pulse interpolator 59 interpolates excitation pulses in each subframe in the manner described in conjunction with the first interpolator 42 illustrated in FIG. 1. Such interpolation is carried out during a current one of the frames by the use of regenerated excitation pulses which are placed in a preceding and a following frame. Thus, the regenerated excitation pulses and the interpolated excitation pulses for the current frame are sent to a synthesizing filter circuit 62.

The synthesizing filter circuit 62 is operable in the manner described in conjunction with the synthesizing filter 22 of FIG. 1 and produces a reproduction $\hat{x}(n)$ of the discrete pattern signal for one frame in response to the interpolated K parameter signals and the regenerated and interpolated excitation pulses. The reproduction $\hat{x}(n)$ of the discrete pattern signal is faithfully indicative of the discrete pattern signal x(n) because the interpolation is carried out in the decoder.

Figure 6:
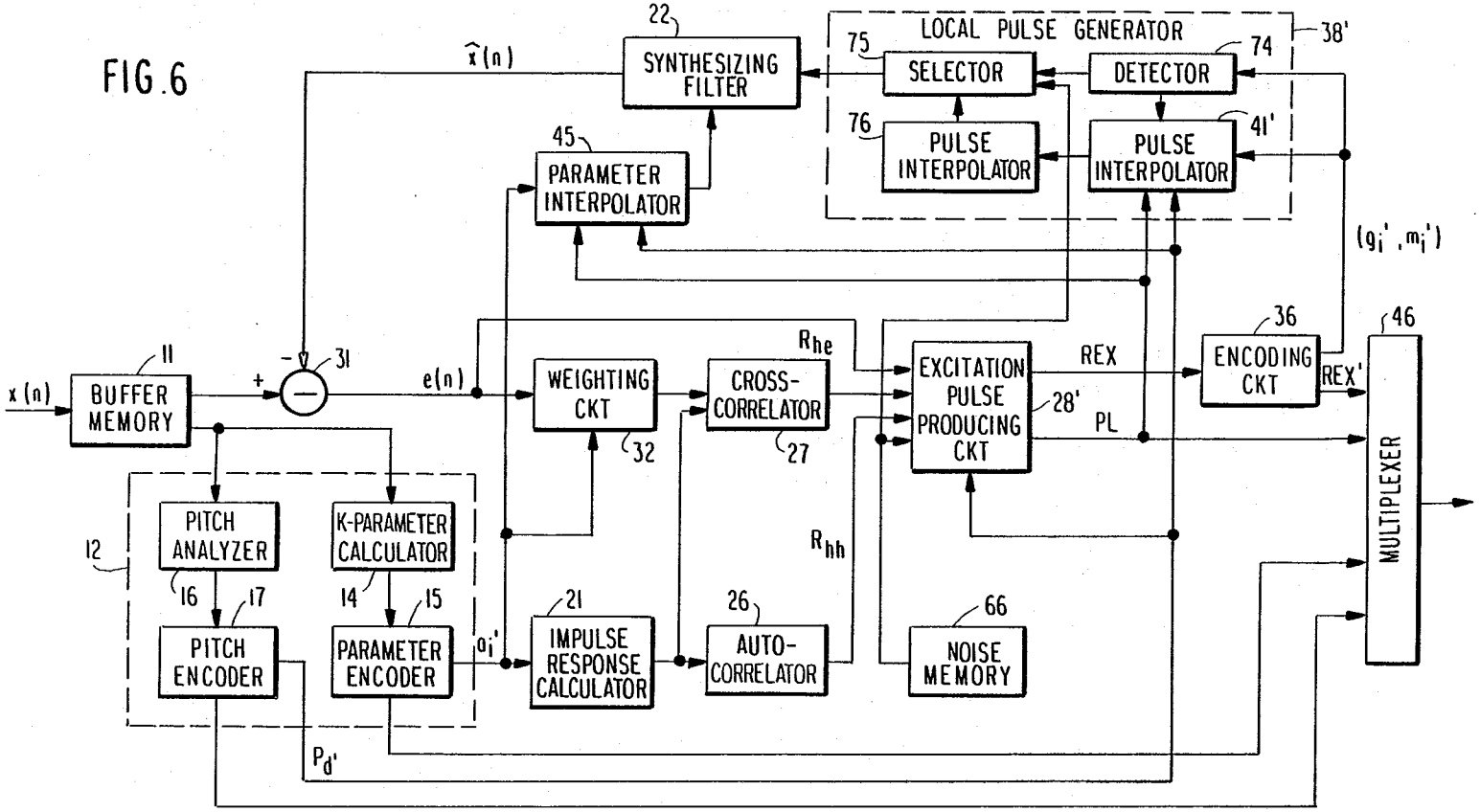
FIG. 6 is a block diagram of an encoder for use in a method according to a second embodiment of this invention.

Referring to FIG. 6, an encoder is applicable to a method according to a second embodiment of this invention and is similar to that illustrated in FIG. 1 except that the encoder shown in FIG. 6 comprises a noise memory 66, an excitation pulse producing circuit 28' cooperating with the noise memory 66, a local pulse generator 3' operable in cooperation with the noise memory 66. The noise memory 66 stores different species of noises signals which are equal in number, for example, to 128 and which are successively read out of the noise memory 66 each time when accessed.

Each noise is successively sent to the excitation pulse producing circuit 28' to be processed in a manner to be described later. Like in FIG. 1, the excitation pulse producing circuit 28' is supplied with the cross-correlation signal $R_{he}$ and the autocorrelation signal $R_{hh}$ from the cross-correlator 27 and the autocorrelator 26, respectively. In addition, the results e(n) of subtraction are delivered from the subtractor 31 to the illustrated excitation pulse producing circuit 28'. The cross-correlation signal $R_{he}$, the autocorrelation signal $R_{hh}$, and the results e(n) of subtraction may collectively be called a preliminarily processed signal.

Figure 7:
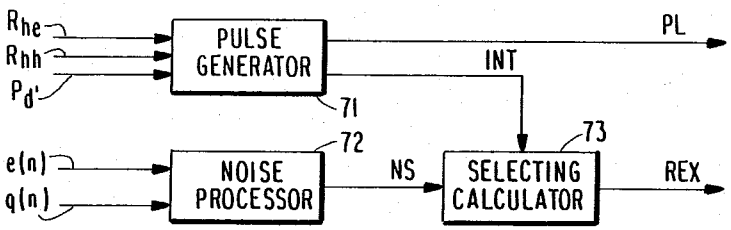
FIG. 7 is a block diagram of a part of the encoder illustrated in FIG. 6.

Referring to FIG. 7 together with FIG. 6, the excitation pulse producing circuit 28' comprises a pulse generator 71 which may be equivalent to the excitation pulse producing circuit 28 illustrated in FIG. 3. At any rate, the pulse generator 71 produces the amplitudes and locations of the representative excitation pulses as internal excitation pulses INT and the encoded pitch location signal PL in response to the autocorrelation signal $R_{hh}$, the cross-correlation signal $R_{he}$, and the decoded pitch period signals Pd'. The internal excitation pulses INT are equal to the representative excitation pulses REX described in conjunction with FIGS. 1 and 3.

The illustrated excitation pulse producing circuit 28' comprises a noise processor 72 operable in response to the results e(n) of subtraction and the noise depicted at q(n). The noise processor 72 calculates a difference d of electric power between the results e(n) of subtraction and a signal $\hat{x}(n)$ synthesized from the noise q(n). Subsequently, one of the noise signals is selected such that the difference of power d becomes minimum.

More specifically, the difference d of power is given by:

$$\begin{aligned} d &= \sum_n [e(n) - \hat{x}(n)]^2 \\ &= \sum_n [e(n) - Gq(n) \times h(n)]^2, \end{aligned} \tag{3}$$

where G is representative of an amplitude of each noise q(n) and h(n), an impulse response of a synthesizing filter, such as 22. It is possible to calculate an optimum amplitude G for each noise in compliance with Equation (3). In addition, the difference d for the optimum amplitude G is also calculated by the use of an autocorrelation function and a cross-correlation function. The noise processor 72 therefore carries out the above-mentioned calculations about all of the stored noise signals to determine the one of the noises such that the difference d becomes minimum. The one of the noise signals determined by the noise processor 72 is supplied as a selected noise NS to a selecting calculator 73. The selected noise NS lasts for one frame.

Alternatively, the noise processor 72 may carry out calculation of Equation (3) so as to directly calculate the difference d. Such calculation is very effective when a characteristic of a vocal source is gradually varied, which appears, for example, at a transition time instant between the voiced speech and the unvoiced speech.

Responsive to the internal excitation pulses INT and the selected noise NS, the selecting calculator 73 selects either the internal excitation pulses INT or combinations of the internal excitation pulses INT and the selected noise NS such that the difference d becomes small. Either the internal excitation pulses INT or the above-mentioned combinations are sent to the encoding circuit 36 as representative excitation signals depicted at REX. Thus, the combinations include the internal signals INT and the selected noise pulses NS arranged in a time division fashion for each frame.

When the internal excitation pulses INT are selected as the representative excitation signals REX by the selecting calculator 73, the representative excitation signals REX are encoded by the encoding circuit 36 into amplitude codes and location codes corresponding to the respective internal excitation pulses INT on the one hand and are decoded into decoded amplitudes $g_i'$ and decoded locations $m_i'$ on the other hand in a manner similar to that described in conjunction with FIG. 1. More specifically, the representative excitation signals REX are encoded in a manner similar to that described in U.S. Pat. No. 4,716,592.

When the combination of the internal excitation pulses INT and the selected noise NS is selected as the representative excitation signals REX, the encoding circuit 36 encodes the internal excitation pulses INT in the above-mentioned manner and encodes the selected noise into a noise amplitude code indicative of an amplitude of the selected noise and a noise code indicative of the species of the selected noise. Both of the noise amplitude code and the noise code are represented by a preselected: number of bits. In addition, decoded noise and pulses are sent to the local pulse generator 38'.

The amplitude and location codes REX' are delivered to the multiplexer 46 while either the decoded amplitudes $g_i'$ and the decoded locations $m_i'$ or the decoded noise are delivered to the local pulse generator 38' which is supplied with the encoded pitch location signal PL and the decoded pitch period signal Pd'.

The illustrated local pulse generator 38' comprises a pulse generator 41' similar to that illustrated in FIG. 1 and a detector 74 coupled to the encoding circuit 36. The detector 74 serves to detect whether or not the decoded noise is present in an output signal of the encoding circuit. If the decoded noise is not present, the detector 74 delivers the decoded amplitudes $g_i'$ and the decoded locations $m_i'$ to a pulse interpolator depicted at 76. The pulse interpolator 76 interpolates excitation pulse in each subframe to produce a sequence of reproduced excitation pulses in the manner described in conjunction with the pulse interpolator 42 (FIG. 1). The reproduced excitation pulses are sent through a selector 75 to the synthesizing filter 22. If the decoded noise is detected by the detector 74, the selected noise is selected by the selector 75 and follows the interpolated excitation pulses. As a result, a combination of the interpolated excitation pulses and the selected noise is delivered as an excitation signal sequence to the synthesizing filter 22.

The synthesizing filter 22 is supplied with the interpolated K parameters from a parameter interpolator 45 responsive to the vocal source information including the encoded pitch location signal PL and the representative excitation signals REX. The illustrated parameter interpolator 45 interpolates the K parameters in each subframe for one frame, in a manner similar to that illustrated in FIG. 1 in response to the representative excitation signals REX and the internal excitation pulses INT.

When the representative excitation signals REX are combinations of the internal excitation pulses INT and the selected noise NS, interpolation of the K parameters is made at a preselected interval of time which may be different from the pitch period or the frame. The preselected interval may be a sample period.

Thus, the synthesizing filter 22 is supplied with the interpolated K parameters $K_m'$ in the manner described in FIG. 1 and produces the output sequence $\hat{x}(n)$ for one frame.

Figure 8:
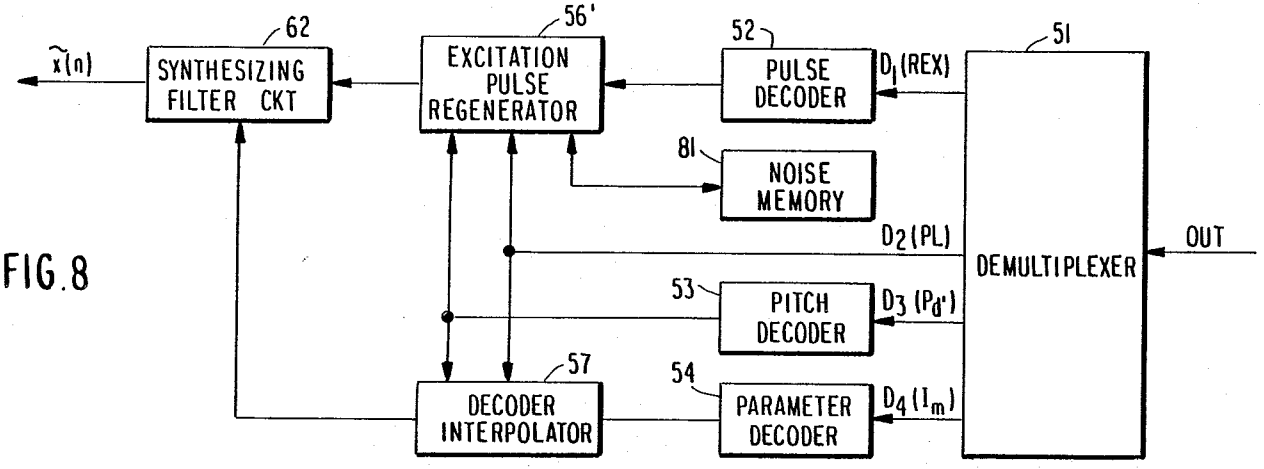
FIG. 8 is a block diagram of a decoder for use in combination with the encoder illustrated in FIG. 6.

Referring to FIG. 8, a decoder is for use in combination with the encoder illustrated in FIG. 6 and is similar to that illustrated in FIG. 5 except that the decoder illustrated in FIG. 8 comprises a noise memory 81, and an excitation pulse regenerator 56' operable in cooperation with the noise memory 81 in a manner to be presently described. Like in FIG. 5, the output code sequence OUT which is sent from the encoder (FIG. 6) is demultiplexed by the demultiplexer 51 into the first through fourth demultiplexed signals D1 to D4. The first, the third, and the fourth demultiplexed signals D1, D3, and D4 are delivered to the pulse decoder 52, the pitch decoder 53, and the parameter decoder 54, respectively. It is to be noted here that the first demultiplexed signal D1 carries information related to the representative excitation signals REX including the selected noise and the internal excitation pulses. The pitch decoder 53 and the parameter decoder 54 produce the decoded pitch parameter and the decoded K parameter, respectively, like in FIG. 5. The decoded pitch parameter is indicative of the pitch period Pd'.

The decoder interpolator 57 is operable to produce the interpolated K parameters, as mentioned in conjunction with FIG. 5.

The excitation pulse regenerator 56' at first monitors the decoded pitch parameter and judges either the internal excitation pulses INT or the selected noise NS.

If the decoded pitch parameter is not equal to zero, the excitation pulse regenerator 56' judges reception of the internal excitation pulses INT as the representative excitation signals REX. In this event, the phase T of the subframes and the location of the representative pitch are extracted from the first demultiplexed code D1 to be decoded into a decoded phase and a decoded location. Subsequently, the frame is divided into the subframes with reference to the decoded phase and the decoded location. At this time, the representative subframe is determined by the decoded phase and location. During the representative subframes, the excitation pulse regenerator 56' produces representative reproduced excitation pulses in response to the amplitude codes and the location codes carried by the first demultiplexed code D1. Interpolation is carried out to produce reproduced excitation pulses during any other subframes than the representative subframe in the manner described in conjunction with FIGS. 5 and 6. Thus, the reproduced excitation pulses are produced for one frame and sent to the synthesizing filter circuit 62.

The excitation pulse regenerator 56' detects reception of the combination of the internal excitation pulses INT and the selected noise NS when the decoded pitch parameter is equal to zero. In this event, the excitation pulse regenerator 56' extracts amplitude codes and location codes of the internal excitation pulses and the noise amplitude code and the noise code of the selected noise pulses from the first demultiplexed code. Such codes are decoded separately from the vocal source information.

As regards the selected noise NS combined with the internal excitation pulses INT, the excitation pulse regenerator 56' accesses the noise memory 81 to read a noise indicated by the noise code out of the noise memory 81. Accessing operation of the noise memory 81 is started when the noise code is detected by the excitation pulse regenerator 56'. The noise is read out of the noise memory 81 as a noise signal for a prescribed number of samples. A noise amplitude G indicated by the noise amplitude code is multiplied by the noise signal to reproduce a vocal source signal v(n) given by:

$$V(n)=G\cdot q_i(n),$$

where i is representative of the noise species stored in the noise memory 81.

The internal excitation pulses INT are decoded into a decoded pulse sequence in the manner described in conjunction with FIG. 6. The decoded pulse sequence is added to the vocal source signal v(n) resulting from the selected noise NS to be reproduced into an excitation vocal source signal.

The synthesizing filter circuit 62 produces a reproduction $\hat{x}(n)$ of the output code sequence x(n) (FIG. 6) for one frame in response to the excitation vocal source signal and the interpolated K parameters.

In the excitation pulse producing circuit 28' illustrated in FIG. 6, the number of the representative excitation pulses may adaptively be varied from zero to four or five, when a vocal source is specified by a combination of the excitation pulses and the noise pulses. This means that the noise alone may be used to specify the vocal source. Such adaptive variation of the excitation pulses serves to faithfully specify various kinds of consonants during an unvoiced time interval and to accomplish a smooth transition between a voiced speech and an unvoiced speech. In this case, it is necessary to transmit information which is representative of the number of the representative excitation pulses and which may be represented by two bits or so per one frame. This might result in an increase of calculation. In order to reduce an amount of calculation, the pitch analyzer 16 may be used. In this event, a pitch gain is calculated by the pitch analyzer 16 in consideration of a value of an autocorrelation function between a current one of the pitches and an adjacent one thereof. Thus, judgement is made to determine either the voiced time interval or the unvoiced one with reference to a magnitude of the pitch gain prior to calculation of the vocal source signal. The judgement of the voiced time interval is followed by producing the representative pitch interval while the judgement of the unvoiced time interval is followed by producing a combination of the noise and the internal excitation pulses.

While this invention has thus far been described in conjunction with a few embodiments thereof, it will readily be possible for those skilled in the art to put this invention into practice in various other manners. For example, interpolation may be carried out along a frequency axis in lieu of a time axis. A predetermined number of excitation pulses may at first be calculated for the entirety of each frame and may be thereafter assigned to each subframe to decide the representative excitation pulses. Such representative excitation pulses may be successively selected from subframes variable at every frame period.

The K parameter may be gradually varied at every subframe on an encoder side, although it is assumed in the above-mentioned embodiments that the K parameter is invariable for each frame during the voiced time interval. More specifically, each K parameter may be interpolated at every subframe with reference to the K parameters in the preceding and following frames and converted into a conversion coefficient to be delivered to the weighting circuit 32 and the impulse response calculator 21. In this case, the cross-correlation function and the autocorrelation function are renewed at every subframe. With this method, it is possible to smooth a spectral variation and to synthesize a voice of a high quality.

Interpolation of the excitation pulses and the K parameters may be carried out in synchronism with the pitch period with reference to the representative pitch interval. Alternatively, interpolation of at least one of the excitation pulses and the K parameters may be made with reference to a predetermined one of the subframes that may be, for example, a central one of the subframes. On carrying out interpolation as mentioned above, it is unnecessary to transmit a code indicative of the location of the representative pitch time interval. The transmission bit rate can therefore be reduced.

The above-mentioned interpolation may not be synchronized with the pitch period. In this event, each frame is divided into a plurality of time intervals of, for example, 2.5 milliseconds which are for interpolation and which may be called interpolation intervals. The interpolation may be carried out at every interpolation interval. In this case, the phase T of the subframes may not be transmitted and therefore, a reduction of the bit rate is possible. A reference one of the interpolation intervals may be adaptively decided on an encoder side or may be fixedly decided at a predetermined one of the interpolation intervals that may be placed adjacent to a central part of each frame. When the reference interpolation interval is fixedly decided, both the phase T of the subframes and the location of the representative pitch may not be transmitted. The bit rate can further be reduced.

The interpolation of the K parameters may be made only on a decoder side in order to reduce an amount of calculation. With this structure, the parameter interpolator 45 may be omitted from the encoder.

The representative pitch interval may be decided by searching, at every frame, a preferable one of the subframes that can faithfully reproduce a voice. In addition, each pitch period may adaptively be varied and interpolated by the use of adjacent ones of the pitch periods preceding and following each pitch period. A variation of the pitch periods becomes smooth and a more faithful voice can be reproduced.

The interpolation for the excitation pulses, K parameters, and pitch periods may not be restricted to linear interpolation. For example, logarithmic interpolation or the like may be used for interpolating the excitation pulses and the pitch periods Instead of the K parameters, interpolation may be made about the prediction coefficients, format parameters, autocorrelation function, and the like in the manner described by B. S. Atal et al in an article entitled "Speech Analysis and Synthesis by Linear Prediction of the Speech Wave" contributed to the Journal of the Acoustical Society of America, pages 637–655, 1971.

Furthermore, each frame may be variable in length, although the K parameters and the excitation pulses are calculated in the above embodiments on condition that the length of each frame is invariable. In this event, a reduction of the bit rate is accomplished by shortening a frame at a transition part of a voice or speech and by lengthening a frame at a stationary part thereof.

If the length of each frame is equal to an integral multiple of the pitch period, transmission of the phase T of the subframes becomes unnecessary.

In FIGS. 1 and 6, the local pulse generator 38 (38'), the synthesizing filter 22, the parameter interpolator 45, and the subtractor 31 may be omitted from the encoder. Thus, the encoder becomes very simple in structure.

The autocorrelation function and the cross-correlation function can be calculated from a power spectrum and a cross power spectrum, respectively, as described by A. V. Oppenheim in "Digital Signal Processing."

Finally, the excitation pulses may be calculated in the excitation pulse producing circuit 28 (28') in various other manners. For example, when a current one of the excitation pulses is calculated, preceding ones of the excitation pulses may be modified in amplitude in consideration of the current excitation pulse.

What is claimed is:

1. A method of encoding a discrete pattern signal into an output code sequence and of decoding said output code sequence into a reproduction of said discrete pattern signal, said discrete pattern signal being divisible into a succession of segments, said method comprising the steps of:

extracting a pitch parameter and a spectral parameter from each segment and from a spectral interval which is not shorter than the segment, respectively;

dividing said spectral interval into a succession of pitch intervals in consideration of the pitch parameters extracted from the respective segments, each pitch interval being shorter than the segments, processing said discrete pattern signal with reference to said spectral parameter and the pitch parameters to produce representative excitation signals specifying the discrete pattern signal in each spectral interval;

coding amplitudes and locations of each of said representation excitation signals into said output code sequence;

separating, from said output code sequence, decoded excitation signals which correspond to said representative excitation signals; and converting said decoded excitation signals into said reproduction of the discrete pattern signal.

2. A method as claimed in claim 1, wherein said representative excitation signals are delimited excitation pulses which are extracted during a selected one of said pitch intervals at every spectral interval

3. A method as claimed in claim 1, wherein said representative excitation signals are a combination of a noise and delimited excitation pulses, said noise being selected in consideration of the discrete pattern signal appearing during each spectral interval while said delimited excitation pulses are extracted during a selected one of said pitch intervals at every spectral interval.

4. A method as claimed in claim 1, wherein said representative excitation signals are a noise selected in consideration of the discrete pattern signal appearing for each spectral interval.

5. A method as claimed in claim 1, wherein said rendering step comprises the steps of:

combining said predetermined number of the representative excitation signals, said spectral parameter, and said pitch parameter into a combined signal; and producing said combined signal as said output code sequence.

6. A method as claimed in claim 5, wherein said separating step comprises the step of:

dividing said output code sequence into said decoded excitation signals and first and second decoded parameters which correspond to said spectral and said pitch parameters, respectively;

said converting step comprises the steps of: interpolating said decoded excitation signals into interpolated excitation signals; and synthesizing said interpolated excitation signals into said reproduction of the discrete pattern signal with reference to said first and second decoded parameters.

7. An encoder for use in encoding a discrete pattern signal into an output code sequence, said discrete pattern signal being divisible into a succession of segments, said encoder comprising:

extracting means for extracting a pitch parameter and a spectral parameter from each segment and from a spectral interval which is not shorter than the segment, respectively;

processing means responsive to said discrete pattern signal, said spectral parameter, and said pitch parameter for processing said each segment with reference to said pitch and said spectral parameters to produce representative excitation signals which specify the discrete pattern signal in each spectral interval and which have amplitudes and locations; and signal producing means coupled to said processing means and said extracting means for coding the amplitudes and the locations of said representative excitation signals with said spectral parameter and said pitch parameter to produce said output code sequence.

8. An encoder as claimed in claim 7, wherein said processing means comprises:

preliminary processing means responsive to said discrete pattern signal and said spectral parameter for processing said discrete pattern signal into a preliminarily processed signal which is indicative of a variable for calculating said representative excitation signal; and calculating means responsive to said preliminarily processed signal and said pitch parameter for calculating said representative excitation signals at every spectral interval.

9. An encoder as claimed in claim 8, wherein said calculating means comprises:

dividing means responsive to said preliminarily processed signal and said pitch parameter for dividing each of said spectral intervals into a succession of pitch interval which is not longer than the segment;

pulse producing means responsive to said preliminarily processed signal for producing a sequence of amplitude and location signals indicative of amplitudes and locations of excitation pulses which lasts for said each spectral interval and which specifies the discrete pattern signal of said each spectral interval; and selecting means operatively coupled to said dividing means and said pulse producing means for selecting a part of said amplitude and location signals which is placed in a selected on of said pitch interval to produce said part of the amplitude and location signals as the amplitudes and locations of said representative excitation signals.

10. An encoder as claimed in claim 8, wherein said calculating means comprises:

noise generating means for successively generating a preselected number of noise signals one at a time;

noise processing means responsive to said preliminarily processed signal and coupled to said noise generating means for processing each of said noise signals to detect an optimum noise signal from said noise signals;

pulse generating means responsive to said preliminarily processed signal and said pitch parameter for generating a sequence of amplitude and location signals indicative of amplitudes and locations of a predetermined number of excitation pulses in a selected on of pitch intervals which are determined with reference to said pitch parameter; and means coupled to said pulse generating means and said noise processing means for producing said representative excitation signals in consideration of said optimum one of the noise signals and said excitation pulses.

11. A decoder for use in combination with the encoder of claim 7, to decode said output code sequence into a reproduction of said discrete pattern signal, said output code sequence carrying the amplitudes and locations of said representative excitation signals and said spectral and said pitch parameters, said decoder comprising:

separating means for separating said output code sequence into decoded spectral and pitch parameters and decoded excitation signals corresponding to the spectral and said pitch parameters and the representative excitation signals, respectively;

processing means for processing said decoded excitation signals into processed pulses;

interpolating means for interpolating said decoded spectral parameters to produce interpolated parameter signals for each of the spectral interval; and producing means responsive to said processed pulses and said interpolated parameter signals for producing said reproduction of said discrete pattern signal.

12. A decoder for use in decoding an input signal into a decoded signal, said input signal being derived form a vocal source and carrying a pitch parameter, a spectral parameter, and vocal source information which are all related to said vocal source, said vocal source being selectively specified by first excitation pulses located in a representative interval and by a combination of second excitation pulses and a selected noise, said first and second excitation pulses being indicated by said vocal source information;

a demultiplexer circuit for demultiplexing said input signal into first, second, and third codes which are representative of said pitch parameter, said spectral parameter, and said vocal source information;

an excitation pulse regenerator responsive to said vocal source information for regenerating an excitation vocal source signal specifying said vocal source by processing said first excitation pulses so that a variation of said first excitation pulses becomes smooth when said vocal source is specified by said first excitation pulses and, otherwise, by producing a reproduction of said second excitation pulses and said selected noise with reference to said vocal source information; and a synthesizing filter responsive to said excitation vocal source signal and said spectral parameter for synthesizing said decoded signal.

13. An encoder as claimed in claim 10, further including means for producing an error signal sequence e(n) representing the difference between the discrete pattern signal and a synthesized output signal sequence $\hat{x}(n)$, synthesized from the noise signals, q(n), and wherein said noise processing means comprise means for calculating the power difference, d, between the error signal, e(n), and the synthesized output signal, $\hat{x}(n)$, for each of the noise signals, q(n), means for determining the minimum difference, $d_{min}$, and means for detecting the noise signal corresponding to the minimum difference, $d_{min}$, as the optimum noise signal.

14. An encoder as claimed in claim 13, wherein said means for calculating the power difference, d, includes means for calculating the power difference according to the equation:

$$d = \sum_n [e(n) - \hat{x}(n)]^2 = \sum_n [e(n) - Gq(n) \times h(n)]^2$$

where:

G represents the amplitude of the noise signal q(n), and h(n) is an impulse response of a synthesizing filter.

* * * * *

UNITED STATES PATENT AND TRADEMARK OFFICE

CERTIFICATE OF CORRECTION

PATENT NO. : 4,821,324

DATED : April 11, 1989

INVENTOR(S) : KAZUNORI OZAWA ET AL

It is certified that error appears in the above-identified patent and that said Letters Patent is hereby corrected as shown below:

Col. 4, line 29, delete "n" and insert --n--.

line 30, delete "n" and insert --n--.

line 38, delete "m" and insert --m--.

line 55, delete "encoder" and insert --encoder 15--.

Col. 5, line 50, delete "$x(\hat{n})$" and insert --$\hat{x}(n)$--.

Col. 8, line 21, delete "j" and insert --j--.

Col. 10, line 3, delete "$\hat{x}(n)$" and insert --$\tilde{x}(n)$--.

line 7, delete "$\hat{x}(n)$" and insert --$\tilde{x}(n)$--.

line 16, delete "generator 3'" and insert --generator 38'--.

Col. 13, line 30, delete "i" and insert --i--.

UNITED STATES PATENT AND TRADEMARK OFFICE

CERTIFICATE OF CORRECTION

PATENT NO. : 4,821,324

DATED : April 11, 1989

INVENTOR(S) : Kazunori Ozawa et al

It is certified that error appears in the above-identified patent and that said Letters Patent is hereby corrected as shown below:

Col. 13, line 39, delete "$\hat{x}(n)$" and insert --$\tilde{x}(n)$--.

Signed and Sealed this

Thirteenth Day of March, 1990

*Attest:*

JEFFREY M. SAMUELS

*Attesting Officer*

*Acting Commissioner of Patents and Trademarks*